US006296728B1

(12) United States Patent
Mao

(10) Patent No.: US 6,296,728 B1
(45) Date of Patent: Oct. 2, 2001

(54) BRASSIERE AND MANUFACTURING PROCESS THEREOF

(76) Inventor: Shirley Mao, No. 18, Alley 6, Lane 8, Anchu Street, Taipei (TW)

( * ) Notice: Subject to any disclaimer, the term of this patent is extended or adjusted under 35 U.S.C. 154(b) by 0 days.

(21) Appl. No.: 09/633,880

(22) Filed: Aug. 7, 2000

(51) Int. Cl.[7] ..... B32B 31/00

(52) U.S. Cl. ..... 156/73.1; 156/245; 156/272.2; 264/445

(58) Field of Search ..... 156/73.1, 242, 156/245, 272.2; 264/442, 443, 445

(56) References Cited

U.S. PATENT DOCUMENTS 4,172,002 * 10/1979 Gluckin ..... 156/245
4,572,195 * 2/1986 Hyams ..... 128/463
5,820,443 * 10/1998 Burr ..... 450/40
5,873,768 * 2/1999 Fleischman-Ament et al. ..... 450/19

FOREIGN PATENT DOCUMENTS

0752213-A1 * 8/1997 (EP) .

* cited by examiner

*Primary Examiner*—James Sells
(74) *Attorney, Agent, or Firm*—Dougherty & Troxell

(57) ABSTRACT

A manufacturing process for brassiere, and especially for a brassiere of front clasp type, comprises a step of left side forming, a step of right side forming, a step of rear piece forming, and a step of joining. Both left part and the right part of the brassiere are integrally formed with a bra cup, an edge piece, and a shoulder band by way of the plastics or the rubber being treated injection molding or vacuum forming respectively. A clasp device is provided to engage the bra cups with shoulder bands having engaging device for engaging the rear piece. Both ends of the rear piece are joined to both the edge pieces respectively.

15 Claims, 5 Drawing Sheets

BRASSIERE AND MANUFACTURING PROCESS THEREOF

BACKGROUND OF THE INVENTION

1. Field of the Invention

The present invention relates to a brassiere and a manufacturing process for the brassiere, and particularly to a brassiere integrally made of the plastics or the rubber being treated by way of injection molding or vacuum forming.

2. Description of Related Art

The brassiere is underwear for women and it is clothing next to skin. Because the breasts of women are different in size, it is not easy to design the brassiere suitable for women. From viewpoint of elegant posture or medicine, it is significant that a good or a bad brassiere affects the health and the modeling of the wearer substantially. Although so called new women emphasize no underwear worn means liberation for women, it may result in lapsed breasts and is not helpful for keeping their figures in shape.

Generally, a brassiere is composed of bra cups, edge pieces, rear pieces, shoulder bands, and a clasp device. A space, which is enclosed by these components, constitutes a configuration of bust. Usually, bra cups have different sizes for personal individuals, and edge pieces and rear pieces determine the size of the brassiere. For a conventional cloth brassiere, a steel wire is inserted into lower edges of the cups respectively and an elastic band or a lace fabric is attached to the outer rim of the brassiere for decoration. Thus, the brassiere can keep contact with the body curve so as to prevent from slip. But, it is often that pressing marks are left on the skin.

On the other hand, the society is getting open such that the topless or partly breast exposure becomes not so surprised to every one. Basically, human body is not evil from the viewpoint of health, but we are restrained morally in the civilization process such that an incorrect thought of nude being guilty is built in our hearts. Although the topless may reach a feeling of liberation as stated above, it may result in distorted and lapsed breasts frequently.

Furthermore, the conventional cloth brassiere has a sophisticated manufacturing process such as multi-steps of sewing, a step of inserting steel wires, and etc. In the meantime, the conventional brassiere is made of cloth such that it is easy to be worn out and be twisted out of shape. Therefore, an improvement for the brassiere is virtually required.

SUMMARY OF THE INVENTION

An object of the present invention is to provide a brassiere, which is snugly worn without pressing marks on the skin.

An another object of the present invention is to provide a brassiere, which is easy to be washed and wiped dry for being reused promptly.

A further object of the present invention is to provide a manufacturing process for above said brassiere, with which less steps are required and a stronger quality can be obtained with lower cost.

BRIEF DESCRIPTION OF THE DRAWINGS

The present invention can be more fully understood by referring to the following description and accompanying drawing, in which.

DETAILED DESCRIPTION OF THE PREFERRED EMBODIMENTS

Figure 1A:
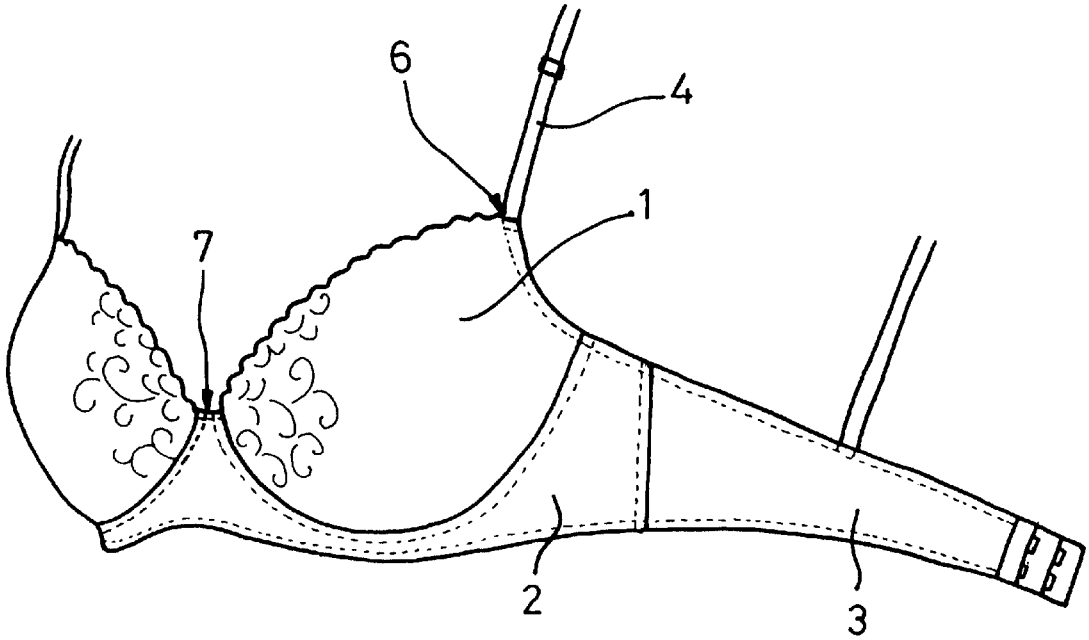
FIG. 1A is a perspective view of a brassiere according to the present invention.
Figure 1B:
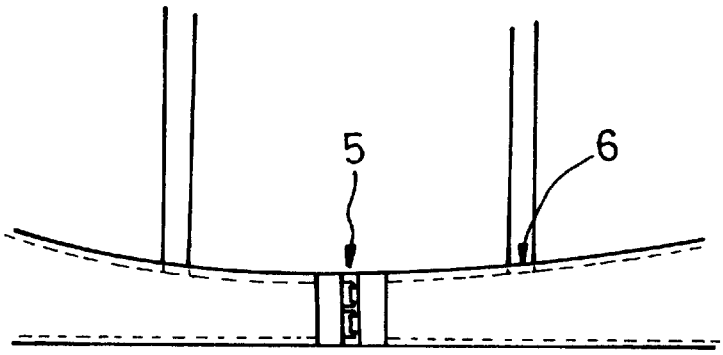
FIG. 1B is a fragmentary rear view of the brassiere shown in FIG. 1.

Referring to FIGS. 1A through 1B, a brassiere 1 according to the present invention basically provides a right and a left bra cups 1, edge pieces 2, a left and a right rear pieces 3, shoulder bands 4, a rear clasp device 5 at ends of the rear pieces 3. An engaging device 6 is provided on the shoulders respectively. The shoulder bands 4 are not provided in case of the brassiere being made without shoulder bands. A brassiere of front clasp type has a front clasp device 7 being located between the bra cups.

The bra cups 1 are made of waterproof material such as porous plastics of high molecular or porous rubber and are preferably formed integrally. Air apertures or surface treatment such as printing may be added to the formed bra cups 1 for beautification. If the bra cups 1 are processed by way of vacuum forming, the rear pieces 3 may be joined then.

The edge pieces 2 are disposed at outer side of the bra cups 1 and made of the same material as the bra cups 1. The edge pieces 2 are formed integrally either to save the working cost and the making process.

The rear pieces 3 are fixedly attached to outer ends of the edge pieces 2 and preferably made of the same material too. In case of injection molding, the rear pieces 3 may be formed integrally with the edge pieces 2. However, in case of vacuum forming, the rear pieces are cut in advance and then to join with the edge pieces 2 by way of, for instance, high frequency wave. The length of each rear piece 3 depends on the bust such that different lengths are available for different sizes of busts.

Whether the shoulder bands 4 being provided or not is determined by the style of brassiere. For a brassiere with shoulder bands, the shoulder bands is integrally formed with the bra cups 1. For a brassiere without shoulder bands, no shoulder bands are required. The shoulder bands 4 are disposed one at the left and the other one at the right respectively extending from the bra cups 1 toward the rear pieces 3. A conventional adjustable buckle can be attached to the shoulder bands 4 respectively such that the lengths of the shoulder bands 4 may be regulated properly.

The rear clasp device 5 provided on the rear pieces for the back is opening brassiere is also called back hook and it is preferable that multiple engaging positions available on the clasp device 5 as the conventional clasp device does so as to be engaged adjustable for different tightness.

The engaging device 6 is provided at both ends of each shoulder band 4 respectively such that the engaging device 6 engages with one of the cups 1 or one of the rear pieces 3 optionally.

The front clasp device 7 is disposed between the cups 1 for the brassiere of front clasp type, but it is not required for the brassiere of rear clasp type.

The brassiere of the present invention has the same parts as the conventional brassiere. But, the brassiere of the present invention is made of high molecular plastics or rubber being formed by injection or vacuum instead of cloth being formed by cutting. The parts in the brassiere of the present invention are joined by way of high frequency pressing or supersonic wave welding, or other equivalent methods.

Therefore, the manufacturing process for the brassiere of the present invention is completely different from that for the conventional cloth brassiere.

Figure 2:
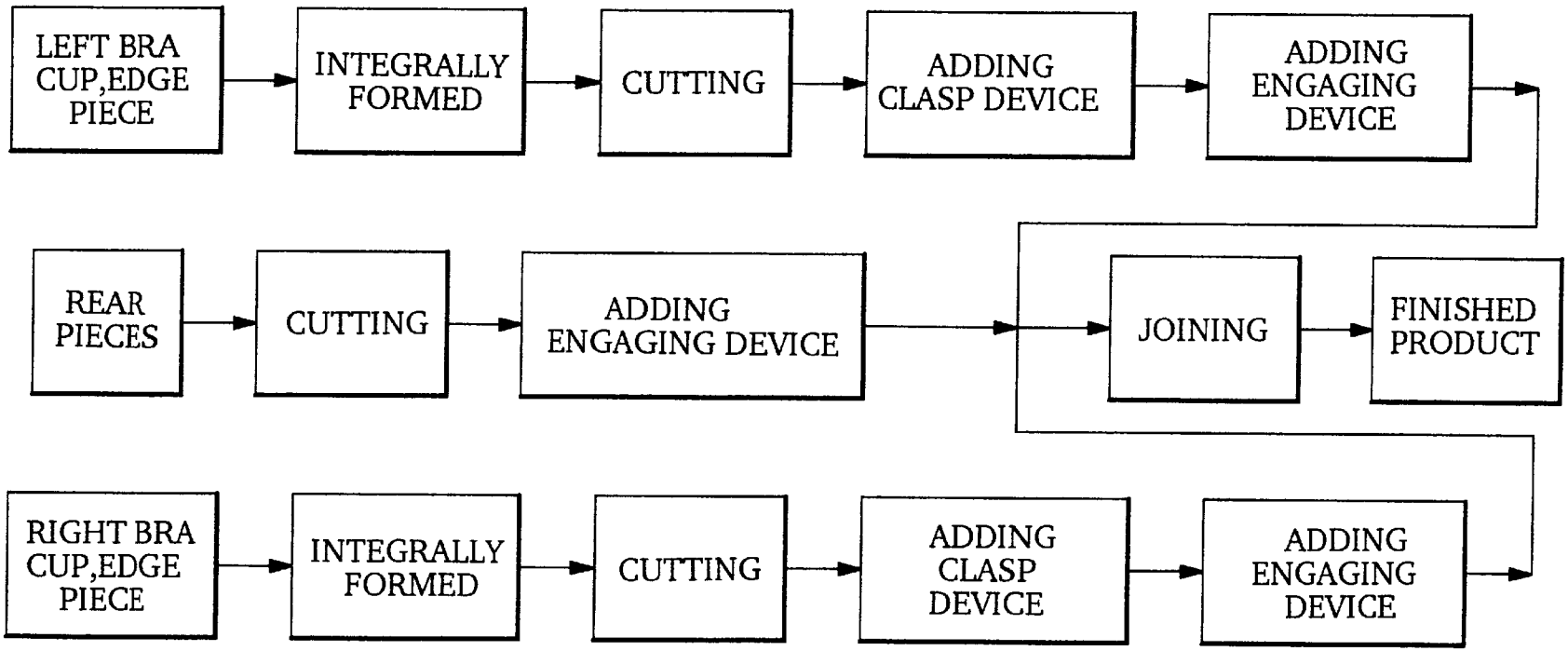
FIG. 2 is a flow chart of making the brassiere of front clasp type by way of vacuum forming according to the present invention.

Referring to FIG. 2, a flow chart of making the brassiere of front clasp type by way of vacuum forming is illustrated. The left and right cups 1, and the edge pieces 2 are made by way of the vacuum forming respectively. The cups 1 are cut into pieces and attached the front clasp device 7, and a respective end of shoulder bands 4 with engaging device 6. In the meantime, the rear pieces 3 are cut and attached by the respective other end of the shoulder bands with engaging device 6. Finally, both ends of the rear pieces 3 are joined to the edge piece 2 respectively.

Figure 3:
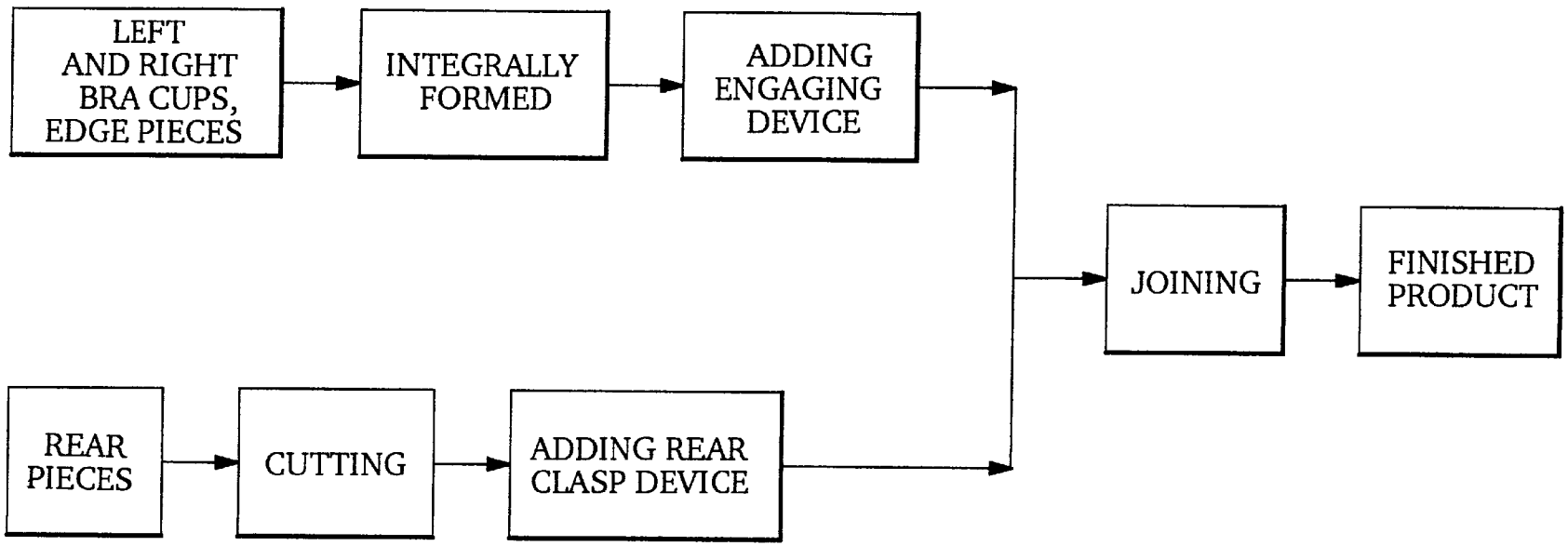
FIG. 3 is another flow chart of making the brassiere of rear clasp type by way of vacuum forming.

Referring to FIG. 3, a flow chart of making the brassiere of rear clasp type by way of vacuum forming is illustrated. First of all, the left and right cups 1, and the edge pieces 2 are made by way of the vacuum forming respectively. The shoulder bands 4 with engaging device 6 are attached to the cups 1 respectively. The rear pieces 3 are cut and attached by a rear clasp device 5 at the same time. Then, the rear pieces 3 are attached to the edge piece 2 finally.

Figure 4:
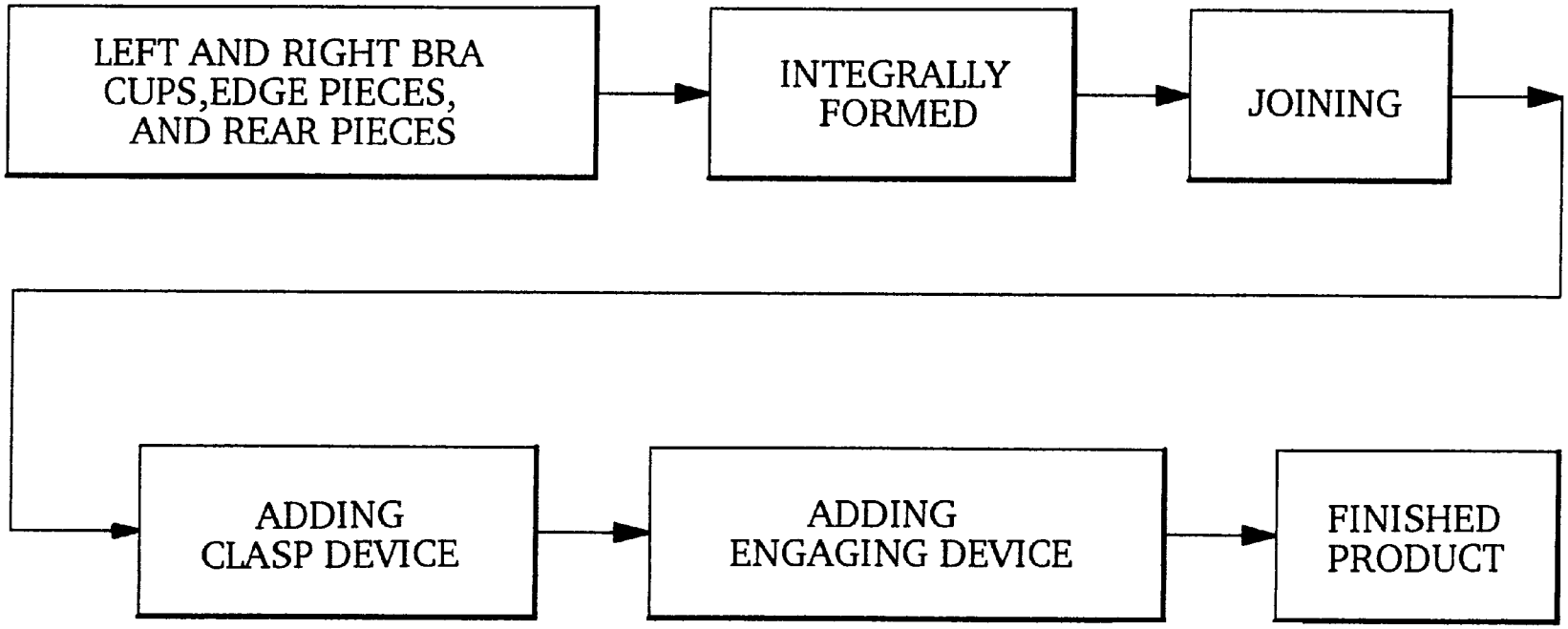
FIG. 4 is a further flow chart of making the brassiere of front clasp type by way of injection molding.

Referring to FIG. 4, a flow chart of making the brassiere of front clasp type by way of injection molding is illustrated. The left and right cups 1 and the edge piece 2 are integrally formed in a mold. Then, the rear pieces 3 are joined. Finally, the front clasp device 7 and the shoulder engaging devices are attached to the cups 1.

Figure 5:
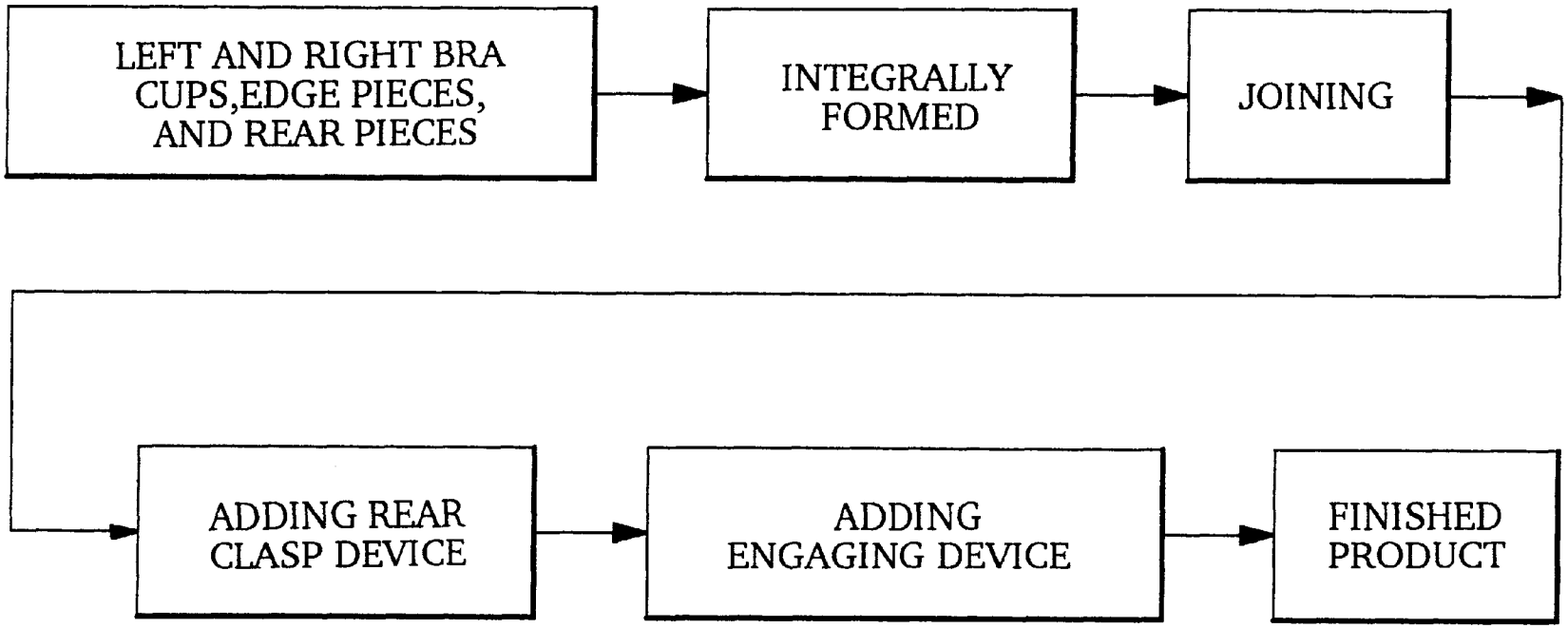
FIG. 5 is a further flow chart of making the brassiere of rear clasp type by way of injection molding.

Referring to FIG. 5, a flow chart of making the brassiere of rear clasp type by way of injection molding is illustrated. The left and right cups 1, the edge piece 2, the rear pieces 3, and the shoulder bands 4 are integrally formed in an injection mold. The ends of the rear pieces 3 are attached by the rear clasp device 5. Finally, the shoulder bands 4 are attached by engaging device 6 respectively.

In practice, the present invention provides a number of advantages and major advantages are listed hereinafter:

1) The brassiere of the present invention keeps a homogeneous thickness without any abruptness to avoid pressing marks on the skin, which the prior art does.
2) The brassiere of the present invention is made of a material with proper elasticity so as to contact with the bust snugly such that the curve of the figure may look conspicuous completely.
3) The brassiere of the present invention can be washed and wiped dry easily so that it is possible to be put on right after cleaning. Therefore, less underwear is needed to prepare for use.
4) The brassiere of the present invention is made of waterproof material such that it can be used as part of swimming suit or part of sports outfit.
5) The brassiere of the present invention can be made of colored material or material with surface printing treatment to enhance the visional delight and fun.

The manufacturing process for the brassiere provides the cups and the edge pieces being integrally formed to lessen the steps of working and the production cost is lowered substantially. All the joining spots are done by way of high frequency wave or supersonic wave such that works are simple and the bonding force is much stronger. Any breaks resulting from loosened thread as occurring in the prior art will not happen in the present invention.

While the invention has been described with reference to a preferred embodiment thereof, it is to be understood that modifications or variations may be easily made without departing from the spirit of this invention, which is defined by the appended claims.

What is claimed is:

1. A manufacturing process for brassiere, and especially for a brassiere of front clasp type, comprising the following steps:

a step of left side forming, a left bra cup, a left edge piece, and a left shoulder band being integrally formed by way of the plastics or the rubber being treated with injection molding or vacuum forming, a clasp device being attached to a lateral edge of the left bra cup, and an end of the shoulder band being attached by an engaging device;

a step of right side forming, a right bra cup, a right edge piece, and a right shoulder band being integrally formed by way of the plastics or the rubber being treated with injection molding or vacuum forming, a clasp device being attached to a lateral edge of the right bra cup, and an end of the right shoulder band being attached by another engaging device;

a step of rear piece forming, a rear piece being formed by way of the plastics or the rubber being cut by mold tool, and then shoulder engaging devices being attached to the rear piece; and a step of joining, both ends of the rear piece being joined the edge pieces surround the left and the right bra cups.

2. The manufacturing process for brassiere according to claim 1, wherein the step of joining is performed by high frequency wave or supersonic wave welding.

3. The manufacturing process for brassiere according to claim 1, wherein the plastics or the rubber is transparent.

4. The manufacturing process for brassiere according to claim 1, wherein the shoulder engaging device on the rear piece engages with the engaging device on the shoulder bands.

5. A manufacturing process for brassiere, and especially for a brassiere of rear clasp type, comprising the following steps:

a step of forming, a left and right bra cups, a left and a right edge pieces, and a left and a right shoulder bands being integrally formed by way of the plastics or the rubber being treated with injection molding or vacuum forming, and the ends of the shoulder bands being attached by an engaging device; and a step of joining, a left and a right rear pieces are joined to the left and the right edge pieces respectively.

6. The manufacturing process for brassiere according to claim 5, wherein the step of joining is performed by high frequency wave or supersonic wave welding.

7. The manufacturing process for brassiere according to claim 5, wherein the plastics or the rubber is transparent.

8. The manufacturing process for brassiere according to claim 5, wherein the rear clasp device on the respective rear piece engages with each other.

9. A manufacturing process for brassiere, and especially for a brassiere of front clasp type, comprising the following steps:

a step of injection, a left and a right bra cups, a left and a right edge pieces, and a left and a right rear pieces being integrally formed by way of the plastics or the rubber being treated with injected mold tool;

a step of adding engaging device, the left and the right bra cups at the inner lateral sides thereof respectively being provided with a clasp device for engaging to each other, the shoulder bands at the ends thereof being provided with an engaging device respectively, and the left and the right rear pieces being joined to the left and the right edge pieces respectively.

10. The manufacturing process for brassiere according to claim 9, wherein the plastics or the rubber is transparent or semi-transparent.

11. The manufacturing process for brassiere according to claim 9, wherein the shoulder band engaging device can engage with the rear pieces.

12. A manufacturing process for brassiere, and especially for a brassiere of rear clasp type, comprising the following steps:

a step of injection, a left and a right bra cups, a left and a right edge pieces, and a left and a right rear pieces being integrally formed by way of the plastics or the rubber being treated by injected mold tool; and a step of adding engaging device, the left and the right rear pieces at ends thereof being attached by a clasp device respectively.

13. The manufacturing process for brassiere according to claim 12, wherein the left and the right shoulder bands may be injected at the same time by way of injection mold tool and be attached by a shoulder band engaging device to engage with the rear pieces respectively.

14. The manufacturing process for brassiere according to claim 12, wherein the plastics or the rubber is transparent or semi-transparent.

15. A front clasp brassiere made by the following steps:

a step of left side forming, a left bra cup, a left edge piece, and a left shoulder band being integrally formed by way of the plastics or the rubber being treated with injection molding or vacuum forming, a clasp device being attached to a lateral edge of the left bra cup, and an end of the shoulder band being attached by an engaging device;

a step of right side forming, a right bra cup, a right edge piece, and a right shoulder band being integrally formed by way of the plastics of the rubber being treated with injection molding or vacuum forming, a clasp device being attached to a lateral edge of the right bra cup, and an end of the right shoulder band being attached by another engaging device;

a step of rear piece forming, a rear piece being formed by way of the plastics or the rubber being cut by mold tool, and then shoulder engaging devices being attached to the rear piece; and a step of joining, both ends of the rear piece being joined the edge pieces surround the left and the right bra cups.

* * * * *